US012663225B2

(12) United States Patent
Lee et al.

(10) Patent No.: US 12,663,225 B2
(45) Date of Patent: Jun. 23, 2026

(54) HEAT EXCHANGER

(71) Applicant: Samsung Electronics Co., Ltd., Suwon-si (KR)

(72) Inventors: Wonjoo Lee, Suwon-si (KR); Kangtae Seo, Suwon-si (KR); Jaehyo Jeong, Suwon-si (KR); Yonghwa Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 93 days.

(21) Appl. No.: 18/658,911

(22) Filed: May 8, 2024

(65) Prior Publication Data

US 2024/0288232 A1 Aug. 29, 2024

Related U.S. Application Data

(63) Continuation of application No. PCT/KR2022/019804, filed on Dec. 7, 2022.

(30) Foreign Application Priority Data

Feb. 4, 2022 (KR) ..... 10-2022-0015112

(51) Int. Cl.
*F28F 9/02* (2006.01)

(52) U.S. Cl.
CPC ..... *F28F 9/0246* (2013.01); *F28F 9/0273* (2013.01); *F28F 9/0204* (2013.01)

(58) Field of Classification Search
CPC ..... F28F 9/0273; F28F 9/0204; F28F 9/0246
See application file for complete search history.

(56) References Cited

U.S. PATENT DOCUMENTS 3,399,656 A * 9/1968 Strohmeyer, Jr. ..... F22B 29/023 122/406.4
7,066,243 B2 6/2006 Horiuchi et al.
(Continued)

FOREIGN PATENT DOCUMENTS

CN 105485972 A * 4/2016
CN 207180448 U * 4/2018
(Continued)

OTHER PUBLICATIONS

International Search Report and Written Opinion of the International Searching Authority dated Mar. 24, 2023, in connection with International Application No. PCT/KR2022/019804, 9 pages.

*Primary Examiner* — Eric S Ruppert

(57) ABSTRACT

Disclosed herein is a heat exchanger including a plurality of tubes configured to enable refrigerant to flow therein, the plurality of tubes arranged along one direction and divided into a first row and a second row, a header coupled to ends of the plurality of tubes and including a first chamber to supply refrigerant to the first row of tubes and a second chamber to be supplied with refrigerant from the second row of tubes, wherein the first chamber includes a first region defined in the one direction between two tubes disposed at opposite ends of the first row of tubes, and the second chamber includes a second region defined in the one direction between two tubes disposed at opposite ends of the second row of tubes, an inlet pipe communicating with the first chamber within the first region to supply refrigerant to the first chamber, and an outlet pipe communicating with the second chamber within the second region to discharge refrigerant of the second chamber.

18 Claims, 17 Drawing Sheets

(56) References Cited

U.S. PATENT DOCUMENTS

| | | | |
|---|---|---|---|
| 9,546,824 | B2 | 1/2017 | Seo et al. |
| 9,903,667 | B2 | 2/2018 | Seo et al. |
| 10,132,537 | B1 | 11/2018 | Stamp et al. |
| 11,236,954 | B2 | 2/2022 | Takafuji |
| 2006/0070399 | A1 | 4/2006 | Bae et al. |
| 2008/0023184 | A1 | 1/2008 | Beamer et al. |
| 2008/0078541 | A1 | 4/2008 | Beamer et al. |
| 2011/0000255 | A1 | 1/2011 | Taras et al. |
| 2011/0127023 | A1 | 6/2011 | Taras et al. |
| 2014/0096944 | A1 | 4/2014 | Seo et al. |
| 2016/0363392 | A1 | 12/2016 | Winterstten et al. |
| 2020/0132378 | A1 | 4/2020 | Dong et al. |

FOREIGN PATENT DOCUMENTS

| | | | | | |
|---|---|---|---|---|---|
| CN | 208187187 | | | 12/2018 | |
| JP | 2007-205630 | A | | 8/2007 | |
| JP | 2016-183847 | A | | 10/2016 | |
| JP | 2018-119743 | A | | 8/2018 | |
| JP | 2020-521103 | A | | 7/2020 | |
| KR | 10-2004-0012939 | A | | 2/2004 | |
| KR | 10-2011-0030979 | A | | 3/2011 | |
| KR | 10-2014-0045864 | A | | 4/2014 | |
| KR | 10-2014-0125084 | A | | 10/2014 | |
| KR | 10-1462173 | B1 | | 12/2014 | |
| KR | 10-1473873 | B1 | | 12/2014 | |
| KR | 20150125552 | A | * | 11/2015 | ..... F28F 9/22 |
| KR | 10-2158387 | B1 | | 9/2020 | |
| KR | 10-2286155 | B1 | | 8/2021 | |

* cited by examiner

HEAT EXCHANGER

CROSS-REFERENCE TO RELATED APPLICATIONS

This application is a Bypass Continuation application of International Application No. PCT/KR2022/019804, filed Dec. 7, 2022, which claims priority to Korea patent application No. 10-2022-0015112 filed Feb. 4, 2022, in the Korean intellectual property office, the disclosures of which are incorporated by reference herein in their entirety.

BACKGROUND

1. Field

The disclosure relates to a heat exchanger, and more particularly to a heat exchanger having an improved structure to increase a heat exchange area.

2. Description of Related Art

In general, a heat exchanger is a device that exchanges refrigerant with outdoor air, and includes a tube through which refrigerant flows and exchanges heat with external air, heat exchange fins in contact with the tube to increase the heat dissipation area, and a header through which opposite ends of the tube communicate. The heat exchanger may include an evaporator or condenser, and may form a refrigeration cycle device with a compressor to compress the refrigerant and an expansion valve to expand the refrigerant.

Such a heat exchanger may include an inlet pipe through which refrigerant from the outside flows in, and an outlet pipe through which the refrigerant is discharged to the outside. The inlet pipe and the outlet pipe are connected to the header and may supply refrigerant to the tube or receive refrigerant from the tube.

SUMMARY

The present disclosure is directed to a heat exchanger having an improved structure such that the heat exchange efficiency is increased relative to the area of the header.

Further, the present disclosure is directed to a heat exchanger having a structure such that the distribution of refrigerant flowing into a header is improved.

According to an embodiment of the disclosure, a heat exchanger includes a plurality of tubes configured to enable refrigerant to flow therein, the plurality of tubes arranged along one direction and divided into a first row and a second row, a header coupled to ends of the plurality of tubes and including a first chamber configured to supply refrigerant to the first row of tubes and a second chamber configured to receive refrigerant from the second row of tubes, wherein the first chamber includes a first region defined in the one direction between two tubes disposed at opposite ends of the first row of tubes, and the second chamber includes a second region defined in the one direction between two tubes disposed at opposite ends of the second row of tubes, an inlet pipe configured to communicate with the first chamber within the first region to supply refrigerant to the first chamber, and an outlet pipe configured to communicate with the second chamber within the second region to discharge refrigerant of the second chamber.

The first chamber may include a first chamber inlet in communication with the inlet pipe and located in the first region to be supplied with refrigerant from the inlet pipe.

The header may further include a distribution pipe provided in the first chamber, including a distribution pipe inlet configured to communicate with the first chamber inlet and a plurality of distribution holes provided to discharge the refrigerant flowing in through the distribution pipe inlet into the first chamber, and the distribution pipe inlet may be located in the first region of the first chamber corresponding to the first chamber inlet.

The distribution pipe inlet may be located between the plurality of distribution holes in the one direction.

The distribution pipe may further include caps provided at opposite ends of the distribution pipe to close opposite ends of a flow path formed inside the distribution pipe.

The distribution pipe may further include an outer wall extending between the caps provided at opposite ends of the distribution pipe to form the flow path, and the distribution holes and the distribution pipe inlet are formed on the outer wall.

The header may further include a header body defining at least a portion of the first chamber and including the first chamber inlet, and a connector including a connection hole configured to communicate with the distribution pipe inlet and the first chamber inlet, and disposed between the distribution pipe and the header body.

The connection hole of the connector may be located in the first region of the first chamber corresponding to the distribution pipe inlet and the first chamber inlet.

The connector may further include a connection body configured to cover the distribution pipe to seal around the distribution pipe inlet, and a protrusion protruding from the connection body toward the first chamber inlet to contact the first chamber inlet.

The distribution pipe inlet may be formed in a lower portion of the distribution pipe, the connector may be disposed on a lower portion of the distribution pipe inlet, and the first chamber inlet may be formed in a lower portion of the first chamber.

The refrigerant flowing through the inlet pipe may flow into the distribution pipe through the first chamber inlet, the connection hole, and the distribution pipe inlet, and flows into the first chamber through the distribution holes.

The header may further include a distribution baffle disposed in a flow path formed by the first chamber to impart resistance to a flow of the refrigerant discharged from the distribution holes of the distribution pipe.

The distribution baffle may include a through hole portion through which the refrigerant may pass, and a blocking portion contacting an inner surface of the first chamber to reduce the area of the flow path formed by the first chamber.

The distribution baffle may be located between the distribution pipe inlet and the distribution hole in the one direction.

The first chamber may form a single flow path including the first region, and the second chamber may form a single flow path including the second region.

According to another embodiment of the disclosure, a heat exchanger includes a plurality of tubes configured to enable refrigerant to flow therein, arranged along one direction and divided into a first row and a second row, a header coupled to ends of the plurality of tubes and including a first chamber configured to supply refrigerant to the tubes in the first row and a second chamber configured to receive refrigerant from the tubes in the second row, wherein the first chamber includes a first region defined in one direction between two tubes disposed at opposite ends of the tubes in the first row, and the second chamber includes a second region defined in the one direction between two tubes disposed at opposite ends of the tubes in the second row, an inlet pipe configured to communicate with a first chamber inlet formed in the first chamber within the first region to supply refrigerant to the first chamber, an outlet pipe configured to communicate with a second chamber outlet formed in the second chamber within the second region to discharge the refrigerant of the second chamber, and a distribution pipe provided in the first chamber, and including a distribution pipe inlet configured to communicate with the first chamber inlet and a plurality of distribution holes configured to discharge the refrigerant flowing in through the distribution pipe inlet into the first chamber.

The distribution pipe inlet of the distribution pipe may be located within the first region of the first chamber corresponding to the first chamber inlet.

The header may further include a header body defining at least a portion of the first chamber and including the first chamber inlet, and a connector including a connection hole configure to communicate with the distribution pipe inlet and the first chamber inlet, and disposed between the distribution pipe and the header body.

The connection hole of the connector may be located in the first region of the first chamber corresponding to the distribution pipe inlet and the first chamber inlet.

The first chamber may form a single flow path including the first region, and the second chamber may form a single flow path including the second region.

Advantageous Effects

According to aspects of the present disclosure, the heat exchanger may couple tubes over the entire area of the header, thereby increasing the heat exchange efficiency.

According to aspects of the present disclosure, the configuration of the distribution pipe may allow refrigerant to be uniformly distributed in the chamber.

According to aspects of the present disclosure, the configuration of the distribution baffle may allow refrigerant to be uniformly distributed in the chamber.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
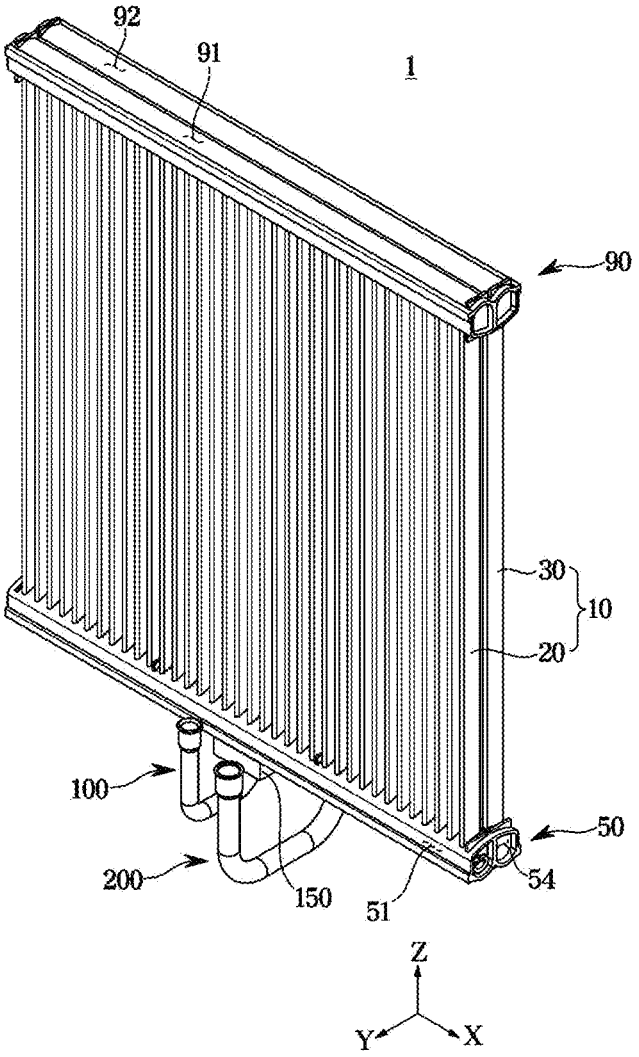
FIG. 1 is a perspective view illustrating an appearance of a heat exchanger according to an embodiment of the present disclosure.

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure and may be used in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter, various embodiments according to the present disclosure will be described in detail with reference to the accompanying drawings.

FIG. 1 is a perspective view showing the appearance of a heat exchanger according to an embodiment of the present disclosure.

Referring to FIG. 1, a heat exchanger 1 according to an embodiment of the present disclosure may include a plurality of tubes 10 through which a refrigerant flows therein and exchanges heat with external air, heat exchange fins (not shown) that contact the tubes to increase a heat transfer area with the external air, a first header 50 and a second header 90 through which the plurality of tubes 10 respectively communicate, an inlet pipe 100 through which refrigerant from the outside flows in, and an outlet pipe 200 through which refrigerant flows out to the outside, and flanges 150 and 250 that secure the inlet pipe 100 and the outlet pipe 200 to the first header 50.

The plurality of tubes 10 may have a plurality of microchannels formed therein to allow refrigerant to flow. The plurality of tubes 10 may be formed flat. The plurality of tubes 10 may be arranged in a vertical direction. The plurality of tubes 10 may be extrusion molded from aluminum.

The heat exchange fins (not shown) may be disposed between the plurality of tubes 10, and may also be disposed to contact outer walls of the tubes 10. The heat exchange fins (not shown) may be provided in various shapes known in the art, and may have louvers to improve heat transfer and drainage performance. The heat exchange fins (not shown) may be formed from an aluminum material and may be coupled to the tubes 10 by brazing.

The plurality of tubes 10 may be arranged along a direction. The plurality of tubes 10 may be arranged to be spaced apart from each other at a given interval along a direction. The plurality of tubes 10 may be arranged along the X-axis, which is a left-to-right direction of the heat exchanger 1. The plurality of tubes 10 may be arranged along a first direction.

The plurality of tubes 10 may be arranged in two rows, a front row and a rear row. The plurality of tubes 10 may be arranged along the Y-axis, which is a front-to-back direction of the heat exchanger 1. The plurality of tubes 10 may be arranged along a second direction. The second direction may be perpendicular to the first direction.

In other words, the plurality of tubes 10 may be divided into a first row of tubes 20 and a second row of tubes 30. The first row of tubes 20 and the second row of tubes 30 may each be arranged along a direction (X-axis direction).

The header may include the first header 50 and the second header 90. The first header 50 and the second header 90 are arranged to be spaced apart from each other by a given interval, and the plurality of tubes 10 may be arranged between the first header 50 and the second header 90. The first header 50 may be positioned on a lower portion of the plurality of tubes 10, and the second header 90 may be positioned on an upper portion of the plurality of tubes 10. The first header 50 and the second header 90 may each be coupled to ends of the plurality of tubes 10.

The first header 50 may include a first chamber 51 and a second chamber 54. The first chamber 51 and the second chamber 54 may be arranged in two rows, a front row and a rear row. The first chamber 51 and the second chamber 54 may be arranged along the Y-axis, which is the front-to-back direction of the heat exchanger 1. The first chamber 51 and the second chamber 54 may be arranged parallel to each other.

The first row of tubes 20 may be coupled to the first chamber 51. The first chamber 51 may supply refrigerant to the first row of tubes 20.

The second row of tubes 30 may be coupled to the second chamber 54. The second chamber 54 may receive refrigerant from the second row of tubes 30.

The second header 90 may include a third chamber 91 and a fourth chamber 92. The third chamber 91 and the fourth chamber 92 may be arranged in two rows, a front row and a rear row. The third chamber 91 and the fourth chamber 92 may be arranged along the Y-axis, which is the front-to-back direction of the heat exchanger 1. The third chamber 91 and the fourth chamber 92 may be arranged parallel to each other.

The first row of tubes 20 may be coupled to the third chamber 91. The third chamber 91 may receive refrigerant from the first row of tubes 20.

The second row of tubes 30 may be coupled to the fourth chamber 92. The fourth chamber 92 may supply refrigerant to the second row of tubes 30.

The inlet pipe 100 may be in communication with the first chamber 51. Refrigerant may flow into the first chamber 51 of the first header 50 via the inlet pipe 100.

The outlet pipe 200 may be in communication with the second chamber 54. Refrigerant in the second chamber 54 of the first header 50 may be discharged to the outside via the outlet pipe 200.

The diameter of the inlet pipe 100 may be smaller than the diameter of the outlet pipe 200. A low temperature, low pressure liquid or gaseous refrigerant that has passed through an expansion valve (not shown) may flow into the inlet pipe 100. The refrigerant flowing into the inlet pipe 100 may absorb heat from the outside as it passes through the tubes 10 to be evaporated, and then flow out to the outside through the outlet pipe 200. Accordingly, in such a refrigeration cycle, the heat exchanger 1 may serve as an evaporator.

Figure 2:
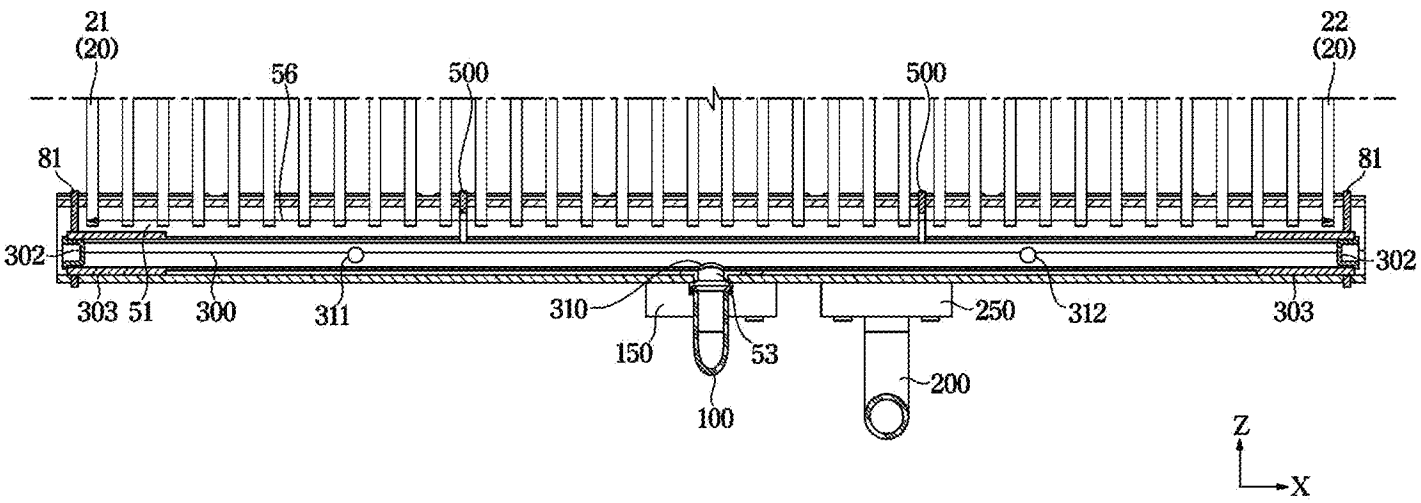
FIG. 2 is a side cross-sectional view of the heat exchanger shown in FIG. 1 from the front.

FIG. 2 is a side cross-sectional view of the heat exchanger shown in FIG. 1 from the front.

The tubes 20 in the first row may include a first tube 21 and a second tube 22 provided at opposite ends. The first row of tubes 20 may include a plurality of tubes disposed between the first tube 21 and the second tube 22. In other words, the first row of tubes 20 may be provided with a plurality of tubes spaced apart from each other at certain intervals from the first tube 21 to the second tube 22.

The first chamber 51 may include a first region 56. The first region 56 may be a region defined in a direction between the two tubes 21 and 22 located at opposite ends of the first row of tubes 20. In other words, the first region 56 may be a region defined in the X-axis direction between the first tube 21 and the second tube 22.

The first region 56 may be a region in which the first row of tubes 20 are disposed. The first region 56 may be a region in which all of the first row of tubes 20 are disposed.

A length of the first region 56 in one direction may correspond to a length of the first row of tubes 20 disposed in one direction. The length along the X-axis of the first region 56 may correspond to the length at which the first row of tubes 20 are arranged along the X-axis. The first tube 21 and the second tube 22 may be disposed at opposite ends of the first region 56.

The inlet pipe 100 may communicate with the first chamber 51 within the first region 56.

The first chamber 51 may include a first chamber inlet 53. The first chamber inlet 53 may communicate with the inlet pipe 100. The first chamber 51 may be supplied with refrigerant from the inlet pipe 100 via the first chamber inlet 53.

The first chamber inlet 53 may be located within the first region 56. The first chamber inlet 53 may be located between the first row of tubes 20. The first chamber inlet 53 may be located between the first tube 21 and the second tube 22. The first chamber inlet 53 may be provided at the center of the first chamber 51.

The first header 50 may include a distribution pipe 300 disposed in the first chamber 51. The distribution pipe 300 may include a distribution pipe inlet 310 that communicates with the inlet pipe 100. The distribution pipe inlet 310 may be located within the first region 56. The distribution pipe inlet 310 may be provided at a position corresponding to the first chamber inlet 53.

The refrigerant flowing through the inlet pipe 100 may flow into the distribution pipe 300 via the first chamber inlet 53 and the distribution pipe inlet 310, and then into the first chamber 51 via distribution holes 311 and 312. The refrigerant flowing into the first chamber 51 may be supplied to the first row of the tubes 20. This will be described later.

Figure 3:
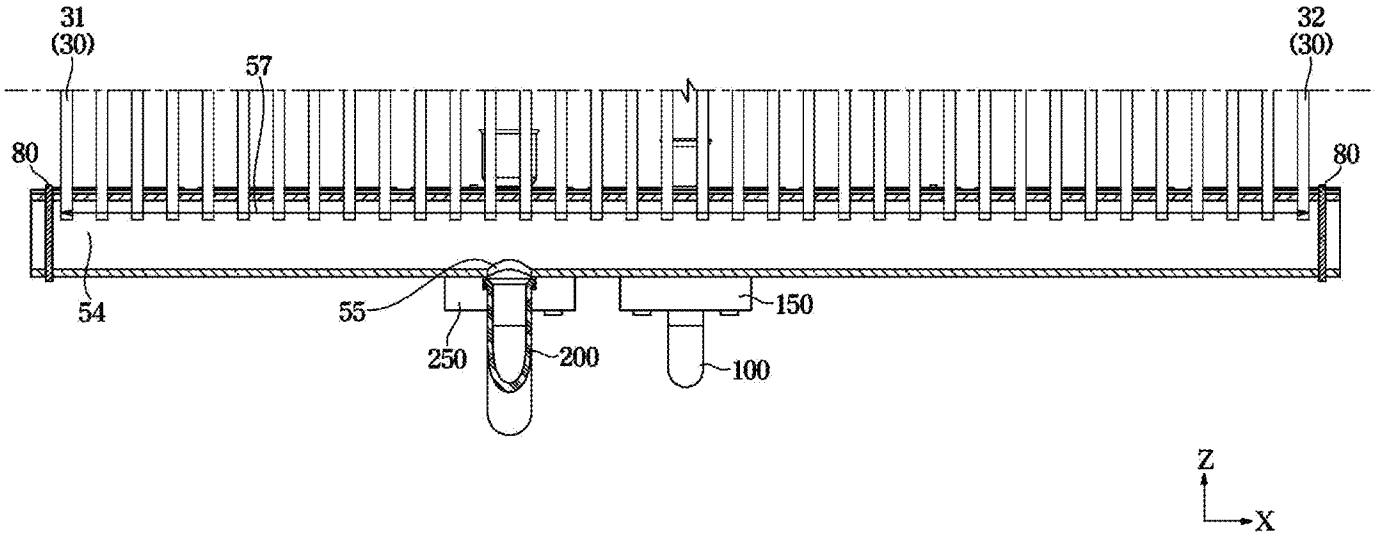
FIG. 3 is a side cross-sectional view of the heat exchanger shown in FIG. 1 from the rear.

FIG. 3 is a side cross-sectional view of the heat exchanger shown in FIG. 1 from the rear.

The tubes 30 in the second row may include a third tube 31 and a fourth tube 32 provided at opposite ends. The second row of tubes 30 may include a plurality of tubes disposed between the third tube 31 and the fourth tube 32. In other words, the second row of the tubes 30 may be arranged to be spaced apart from each other at regular intervals from the third tube 31 to the fourth tube 32.

The second chamber 54 may include a second region 57. The second region 57 may be a region defined in a direction between the two tubes 31 and 32 located at opposite ends of the second row of tubes 30. In other words, the second region 57 may be a region defined in the X-axis direction between the third tube 31 and the fourth tube 32.

The second region 57 may be a region in which the second row of tubes 30 are disposed. The second region 57 may be a region in which all of the second row of tubes 30 are disposed.

A length of the second region 57 in one direction may correspond to a length of the second row of tubes 30 arranged in one direction. The length along the X-axis of the second region 57 may correspond to the length at which the second row of tubes 30 are arranged along the X-axis. The third tube 31 and the fourth tube 32 may be disposed at opposite ends of the second region 57.

The outlet pipe 200 may communicate with the second chamber 54 within the second region 57.

The second chamber 54 may include a second chamber outlet 55. The second chamber outlet 55 may communicate with the outlet pipe 200. The second chamber 54 may discharge refrigerant to the outlet pipe 200 via the second chamber outlet 55.

The second chamber outlet 55 may be located within the second region 57. The second chamber outlet 55 may be located between the second row of tubes 30. The second chamber outlet 55 may be located between the third tube 31 and the fourth tube 32. The second chamber outlet 55 may be arranged to be spaced apart from the first chamber inlet 53 along a direction (X-axis direction).

Figure 4:
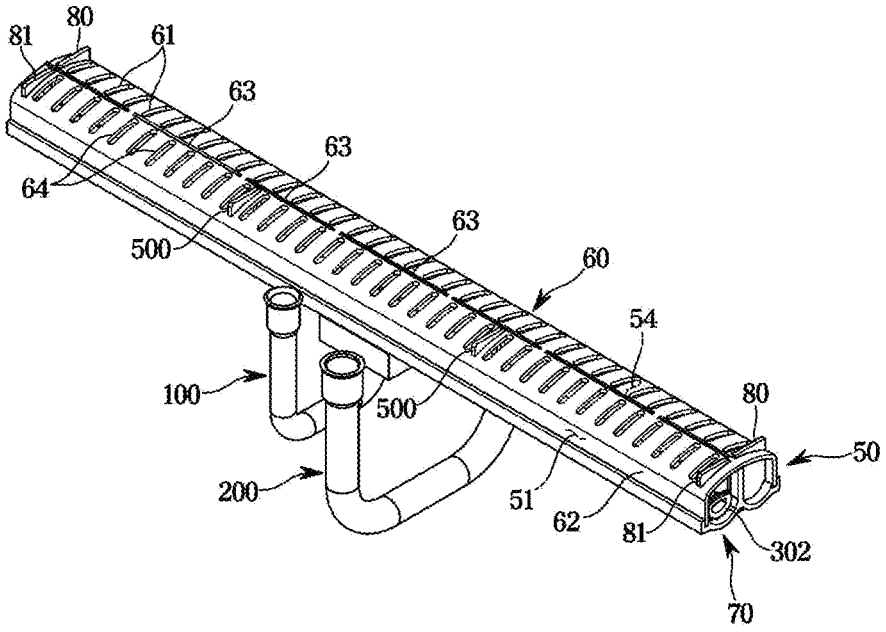
FIG. 4 is a perspective view illustrating a first header and pipes connected to the first header of the heat exchanger shown in FIG. 1.

FIG. 4 is a perspective view showing the first header and pipes connected to the first header of the heat exchanger shown in FIG. 1

The first header 50 may include a header cover 60, a header body 70, cover baffles 80 and 81, and a distribution baffle 500.

The header cover 60 may include tube holes 64 into which the plurality of tubes 10 are inserted. The plurality of tube holes 64 may be arranged in a direction on the header cover 60. The plurality of tube holes 64 may be arranged to be spaced apart from one end to the other end of the header cover 60 at regular intervals.

The pipes may include the inlet pipe 100 and the outlet pipe 200. The pipes may communicate with the first header 50 within the first region 56 or the second region 57. In other words, the inlet pipe 100 may communicate with the first chamber 51 within the first region 56, and the outlet pipe 200 may communicate with the second chamber 54 within the second region 57.

Conventionally, pipes can be installed on a side portion of the first header. In particular, the first header includes a separate installation space for connecting the pipes, and because the pipes communicate with the installation space, tubes are unable to be coupled thereto. As a result, the area in which the tubes are disposed is small compared to the area of the header, thereby reducing the efficiency of the heat exchange.

According to the present disclosure, the pipes may communicate with the header within the region where the plurality of tubes are located, i.e., within the first region or the second region, so that the header does not need to include a separate installation space for connecting the pipes. As a result, the tubes may be coupled from one end to the other end of the header, thereby maximizing the area in which the tubes are installed in the header. In other words, the efficiency of the heat exchange may be maximized relative to the volume of the heat exchanger.

In this case, the refrigerant flowing through the inlet pipe 100 may flow directly into a main chamber without flowing into a separate sub-chamber and then moving into the main chamber to which the tubes are coupled. In other words, the refrigerant flowing through the inlet pipe 100 may flow directly into the first chamber 51.

The inlet pipe 100 and the outlet pipe 200 may be spaced apart from each other along a longitudinal direction of the first header 50 and connected to the first header 50.

While one inlet pipe 100 and one outlet pipe 200 are shown in the drawings, the present disclosure is not limited thereto. When the inlet pipe 100 communicates with the first chamber 51 within the first region 56 and the outlet pipe 200 communicates with the second chamber 54 within the second region 57, the inlet pipe 100 and/or the outlet pipe 200 may be provided in a plurality.

Figure 5:
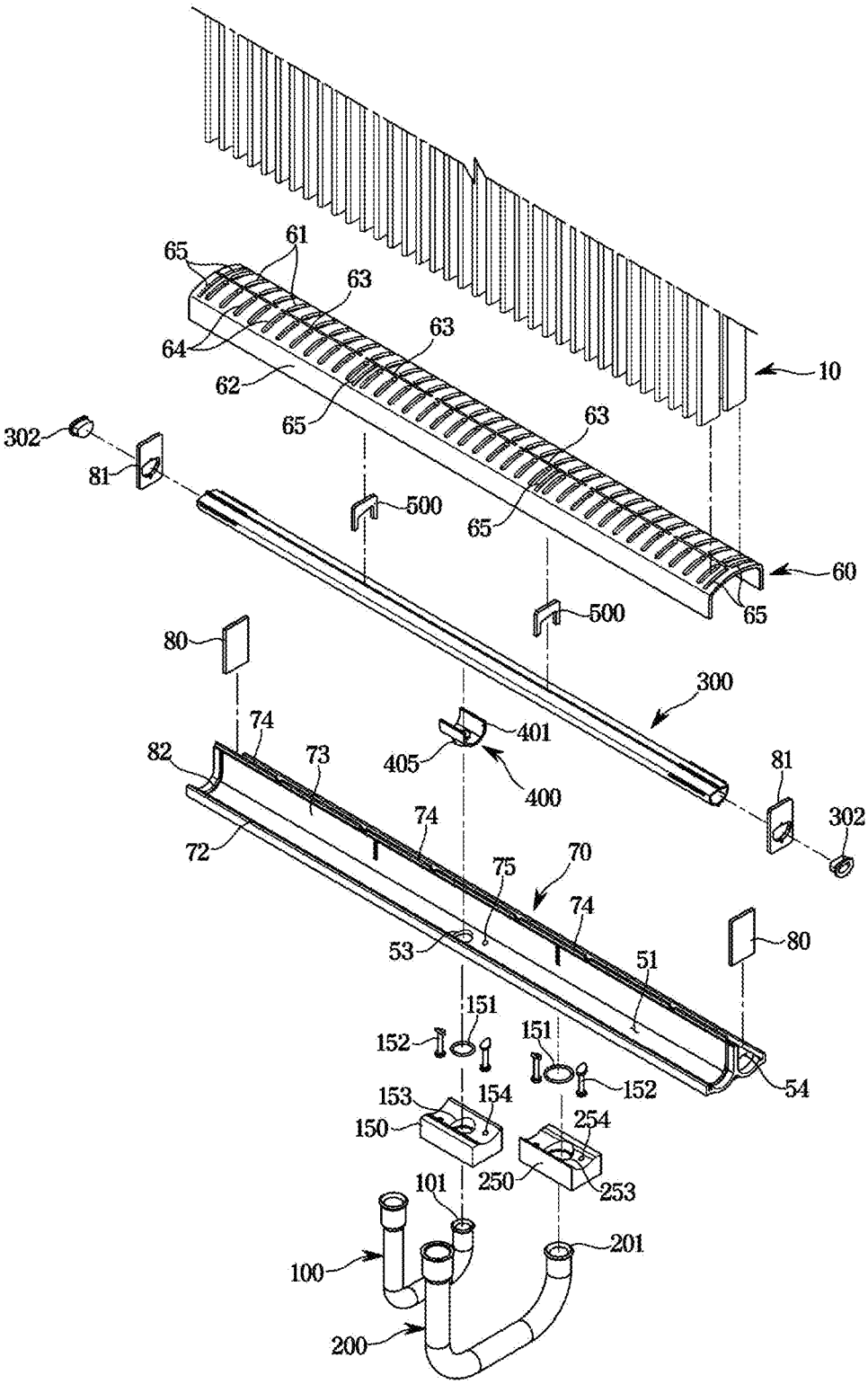
FIG. 5 is an exploded perspective view illustrating a configuration of the heat exchanger shown in FIG. 1.

FIG. 5 is an exploded perspective view showing a configuration of the heat exchanger shown in FIG. 1.

The heat exchanger 1 may include the tubes 10, the first header 50, the pipes 100 and 200, the flanges 150 and 250, solder rings 151, and rivets 152.

The header cover 60 may be coupled to an upper portion of the header body 70. The coupling of the header body 70 and the header cover 60 may allow the first chamber 51 and the second chamber 54 to be divided based on a central partition 73. The cover baffles 80 and 81 may be coupled to opposite ends of the header body 70. The first chamber 51 and the second chamber 54, which are open at opposite ends, may be closed by the cover baffles 80 and 81.

The header cover 60 may include cover baffle holes 65 into which the cover baffles 80 and 81 are inserted. The cover baffle holes 65 may be provided at opposite ends of the header cover 60.

The header cover 60 may include one or more distribution baffle holes 65 into which the one or more distribution baffles 500 are inserted.

The first chamber 51 may be provided with the distribution pipe 300. A connector 400 may be disposed between the first chamber 51 and the distribution pipe 300. A protrusion 405 of the connector 400 may be inserted into the first chamber inlet 53.

The pipes 100 and 200 may be coupled to the header body 70. The inlet pipe 100 may include an inlet pipe port 101 for supplying refrigerant supplied from the outside to the first chamber 51. The outlet pipe 200 may include an outlet pipe port 201 for discharging the refrigerant supplied from the second chamber 54 to the outside.

The inlet pipe port 101 may be inserted into the inlet flange hole 153 of the inlet flange 150. The outlet pipe port 201 may be inserted into the outlet flange hole 253 of the outlet flange 250. The solder rings 151 may be inserted into the inlet flange hole 153 and the outlet flange hole 253, respectively, so that the inlet pipe 100 and the outlet pipe 200 may be easily coupled thereto.

The inlet flange 150 and the outlet flange 250 may include flange rivet holes 154 and 254. The rivets 152 may each be coupled to the flange rivet holes 154 and 254.

The respective rivets 152 may penetrate the flange rivet holes 154 and 254 and the header body rivet holes 75. The rivet 152 may securely couple the pipes 100 and 200 to the header body 70. The rivet 152 may firmly couple the flanges 150 and 250 into which the inlet pipe port 101 and the outlet pipe port 201 are inserted to the header body 70.

Figure 6:
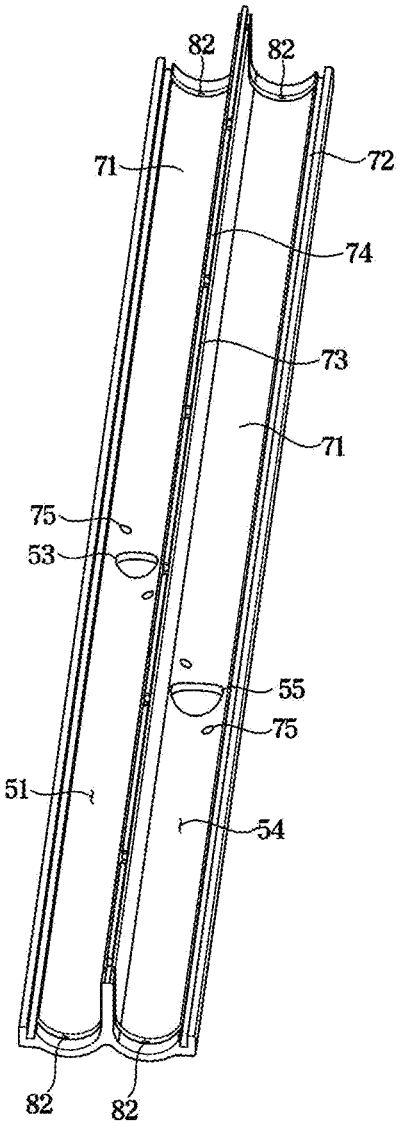
FIG. 6 is a view illustrating a header body.
Figure 7:
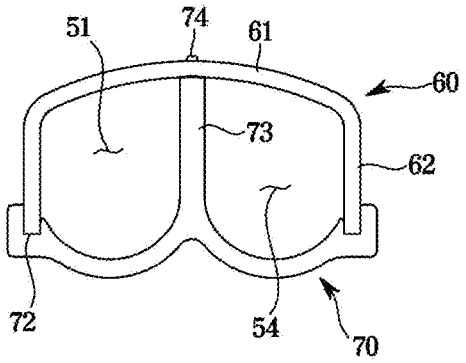
FIG. 7 is a view illustrating the header body with a header cover coupled to the header body.

FIG. 6 is a view showing the header body. FIG. 7 is a view showing the header cover coupled to the header body.

The header body 70 may define at least a portion of the first chamber 51 and/or the second chamber 54. The header cover 60 may be coupled to the header body 70 to form the first chamber 51 and/or the second chamber 54.

The header body 70 may include a bottom portion 71. The bottom portion may include a coupling groove 72 formed in the bottom portion 71. An end of the side wall 62 of the header cover 60 may be inserted into the coupling groove 72, so that the header cover 60 may be coupled to the header body 70.

The first chamber inlet 53 and the second chamber outlet 55 may be formed in the bottom portion 71. The header body rivet holes 75 may be formed in the bottom portion 71.

The header body 70 may include the central partition 73 protruding from the center of the bottom portion 71. The first chamber 51 and the second chamber 54 may be partitioned by the central partition 73. The first chamber inlet 53 and the second chamber outlet 55 may be provided on both sides based on the central partition 73.

Referring to FIG. 5, the header cover 60 may include an upper wall 61 and the side walls 62 extending from both sides of the upper wall 61. Through holes 63 extending in a direction may be formed in the upper wall 61. The respective through holes 63 may be formed in the center of the upper wall 61. A through protrusion 74 formed on the central partition 73 of the header body 70 may be inserted into the through hole 63.

Referring to FIG. 7, the header body 70 and the header cover 60 may be coupled to form the first chamber 51 and the second chamber 54. Both sides of the first chamber 51 and the second chamber 54 may be open. The first chamber 51 and the second chamber 54 may each form a single flow path.

The cover baffles 80 and 81 may be coupled to both ends of the first header 50 to cover both open sides of the first chamber 51 and the second chamber 54. The cover baffles 80 and 81 may be coupled to the first header 50 by being inserted into the cover baffle holes 82 formed in the header body 70 and the header cover 60, respectively. The cover baffles 80 and 81 may be coupled to the first header 50 by brazing.

Figure 8:
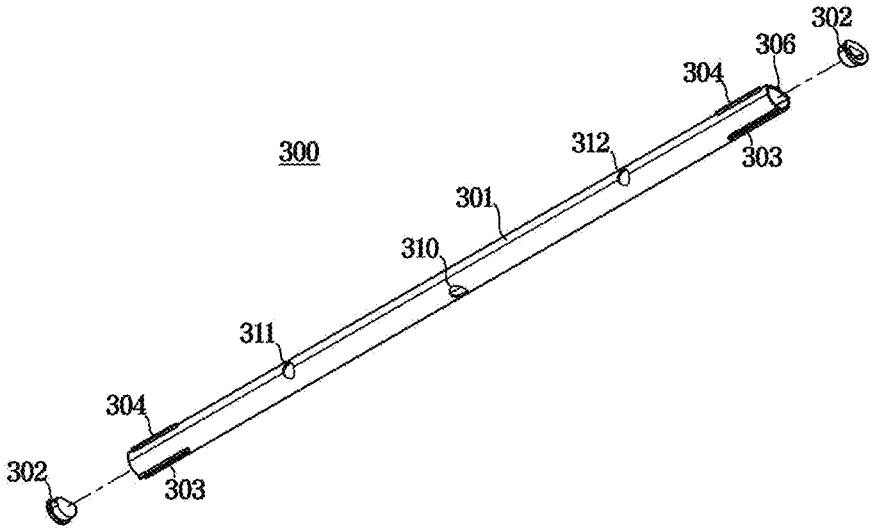
FIG. 8 is a view illustrating a distribution pipe.

FIG. 8 is a view showing the distribution pipe.

The distribution pipe 300 may include an outer wall 301 that has a tubular shape with both sides open. The outer wall 301 may extend between caps 302 to form a flow path. The distribution pipe inlet 310 and the distribution holes 311 and 312 may be formed on the outer wall 301 of the distribution pipe 300. In other words, the distribution pipe inlet 310 may not be formed at an end of the flow path of the distribution pipe 300, but may be formed together with the distribution holes 311 and 312 on the outer wall 301.

The distribution holes 311 and 312 may be provided in a plurality. The distribution holes 311 and 312 may be formed in two, spaced apart by a predetermined distance. The distribution holes 311 and 312 may be arranged to face the central partition 73.

The plurality of distribution holes 311 and 312 may be formed of the same size and shape as each other. The plurality of distribution holes 311 and 312 may be arranged symmetrically about the distribution pipe inlet 310.

The distribution pipe inlet 310 may be formed in a lower portion of the outer wall 301. The distribution pipe inlet 310 may be formed at the center of the distribution pipe 300. The distribution pipe inlet 310 may be formed between the plurality of distribution holes 311 and 312 in a direction. The distribution pipe inlet 310 may be formed at the center of the plurality of distribution holes 311 and 312 to allow refrigerant to be discharged uniformly into the plurality of distribution holes 311 and 312.

The caps 302 may be coupled to both open sides of the outer wall 301 of the distribution pipe 300. The cap 302 may close both sides of the distribution pipe 300. The outer wall 301 and the cap 302 may form an interior space of the distribution pipe 300. Both ends of the flow path formed inside the distribution pipe 300 may be closed by the caps 302, and thus the refrigerant in the distribution pipe 300 may be discharged to the outside through the distribution holes 311 and 312.

Both the distribution pipe 300 and the caps 302 may be formed of aluminum, and the distribution pipe 300 and the caps 302 may be coupled by brazing.

The distribution pipe 300 may include a plurality of ribs 303, 304, 305, and 306 protruding from the outer wall 301.

The plurality of ribs 303, 304, 305, and 306 may include the support ribs 303, 304, and 305 protruding from the outer wall 301 so as to space the outer wall 301 from an inner surface of the first header 50 and supported on the inner surface of the first header 50, and the stopper rib 306 capable of limiting an insertion depth of the tubes 10.

The support ribs 303, 304, and 305 may include the lower support rib 303 protruding toward a lower side of the outer wall 301, the left support rib 304 protruding toward the left side of the outer wall 301, and the right support rib 305 protruding toward the right of the outer wall 301, depending on a direction in which they protrude.

The stopper rib 306 may protrude from an upper portion of the outer wall 301 and may prevent the tubes 10 from being over-inserted into the interior of the first chamber 51.

It may be most advantages for the refrigerant to flow if the outer wall 301 of the distribution pipe 300 and the inner surface of the first header 50 are spaced apart by approximately 1 mm or more.

With such a structure, the refrigerant flowing into the first chamber 51 through the distribution holes 311 and 312 of the distribution pipe 300 may easily flow in the first chamber 51 and be distributed to the first row of tubes 20.

Figure 9:
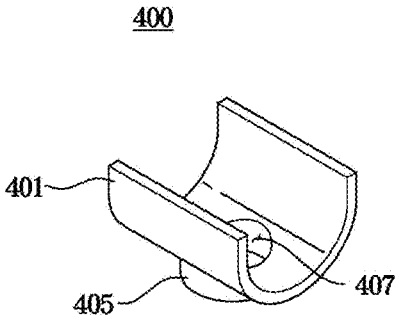
FIG. 9 is a view illustrating a connector.

FIG. 9 is a view showing the connector.

The connector 400 may be disposed between the distribution pipe 300 and the header body 70. The connector 400 may be arranged to cover around the distribution pipe inlet 310 to prevent refrigerant through the first chamber inlet 53 from leaking into the first chamber 51 during a process of flowing into the distribution pipe inlet 310. The connector 400 may be formed to be larger than the area of the distribution pipe inlet 310.

The connector 400 may include a connecting body 401 and a protrusion 405. The connection body 401 may cover the distribution pipe 300. The connection body 401 may include a plate shape. The connection body 401 may include a curved shape corresponding to the shape of the lower portion of the outer wall 301 of the distribution pipe 300.

The protrusion 405 may be inserted into the first chamber inlet 53. The protrusion 405 may contact an inner surface of the first chamber inlet 53 to prevent leakage of refrigerant flowing into the first chamber inlet 53. The protrusion 405 may protrude from the connection body 401 toward the first chamber inlet 53. The protrusion 405 may have a cylindrical shape protruding downwardly from the connection body 401.

The protrusion 405 may include a connection hole 407. The connection hole 407 may communicate with the distribution pipe inlet 310 and the first chamber inlet 53. The connection hole 407 may be disposed to correspond to the positions of the distribution pipe inlet 310 and the first chamber inlet 53. The connection hole 407 may pass through the protrusion 405.

The connector 400 may be formed including a cladding material. In particular, an outer surface of the connector 400 may be formed of a cladding material to be coupled between the distribution pipe 300 and the header body 70 by brazing, so that a gap may be easily sealed.

Figure 10:
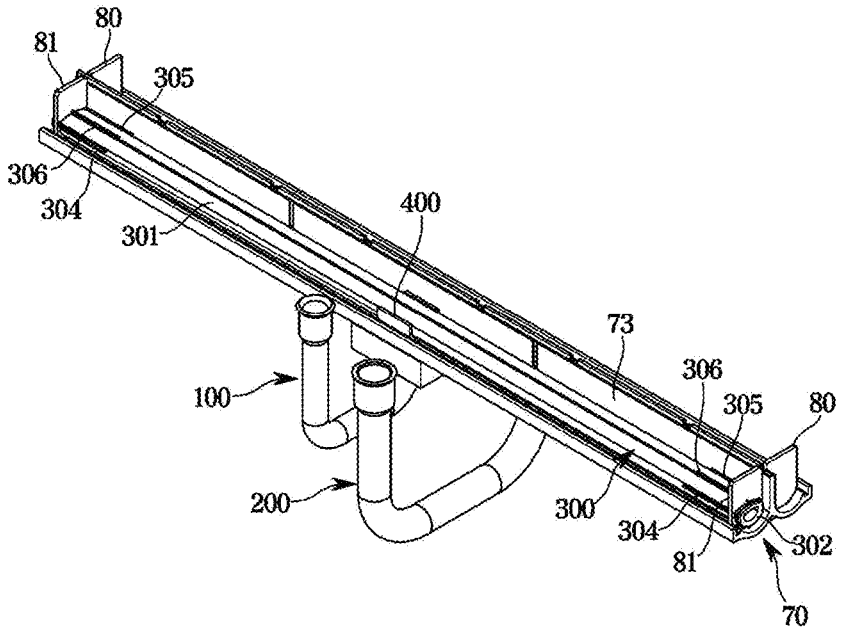
FIG. 10 is a view illustrating a distribution pipe and a distribution pipe connector disposed in a first chamber.
Figure 11:
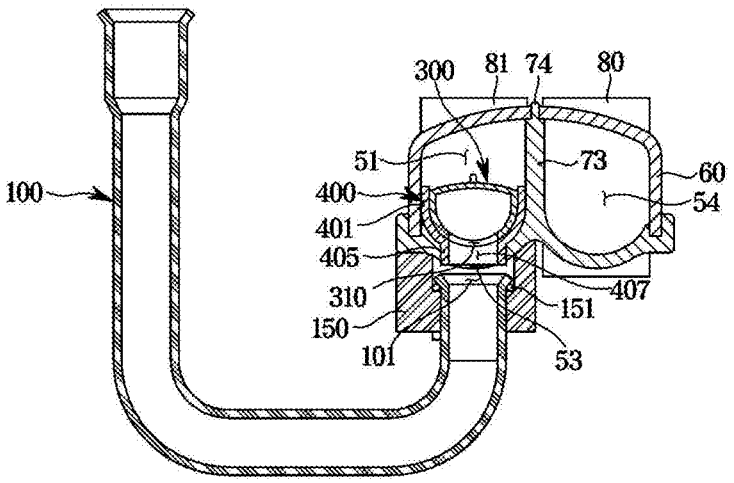
FIG. 11 is a cross-sectional view of an inlet pipe port of FIG. 10.
Figure 12:
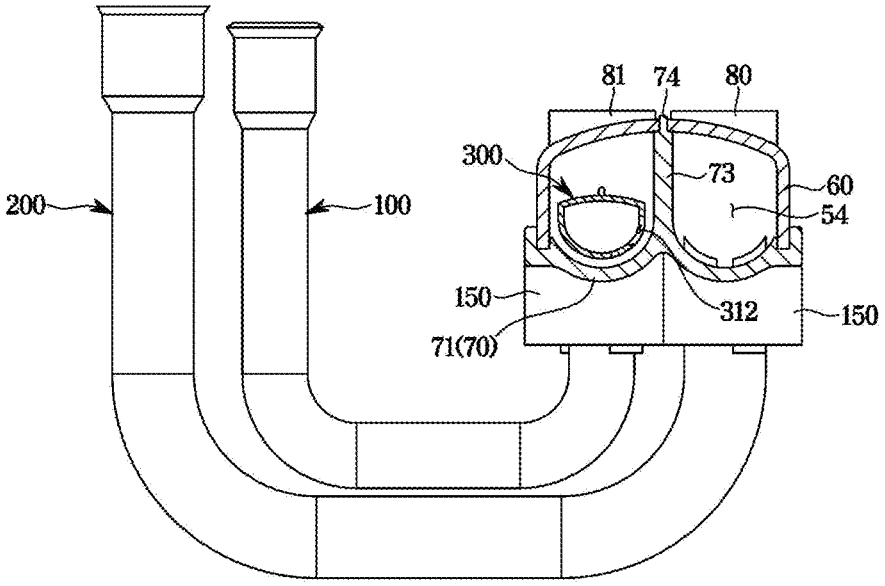
FIG. 12 is a cross-sectional view of a distribution hole of the distribution pipe of FIG. 10.

FIG. 10 is a view showing the distribution pipe and the distribution pipe connector arranged in the first chamber. FIG. 11 is a cross-sectional view of the inlet pipe port shown in FIG. 10. FIG. 12 is a cross-sectional view of the distribution holes of the distribution pipe shown in FIG. 10.

The distribution pipe inlet 310 may be formed in a lower portion of the distribution pipe 300. The connector 400 may be disposed on a lower portion of the distribution pipe inlet 310. The first chamber inlet 53 may be formed in a lower portion of the first chamber 51. As a result, refrigerant may flow into the distribution pipe 300 through the first chamber inlet 53, the connection hole 407 of the connector 400, and the distribution pipe inlet 310.

The inlet pipe 100 may be connected within the first chamber 51 and the first region 56. The inlet pipe port 101, the first chamber inlet 53, the connection hole 407, and the distribution pipe inlet 310 may be arranged in a straight line, and refrigerant may flow into the first chamber 51 therethrough.

Refrigerant flowing through the inlet pipe 100 may flow directly into the distribution pipe 300 via the first chamber inlet 53 and the distribution pipe inlet 310.

Referring to FIG. 12, the refrigerant flowing into the distribution pipe 300 may flow into the first chamber 51 through the distribution hole 312. In other words, refrigerant may be supplied to the first row of the tubes 20 through a dual structure formed by the distribution pipe 300 and the first chamber 51.

Figure 13:
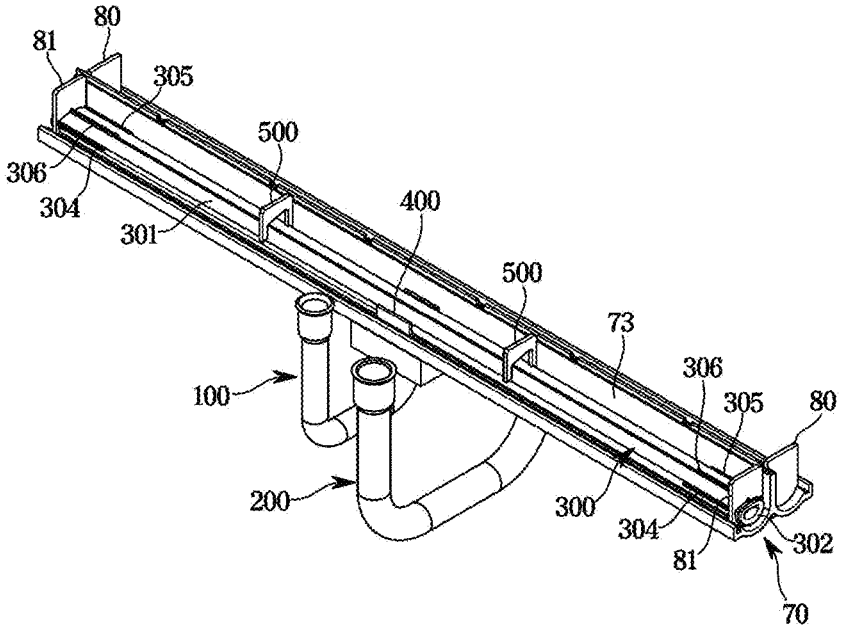
FIG. 13 is a view illustrating the distribution pipe, the distribution pipe connector, and distribution baffles, disposed in the first chamber.
Figure 14:
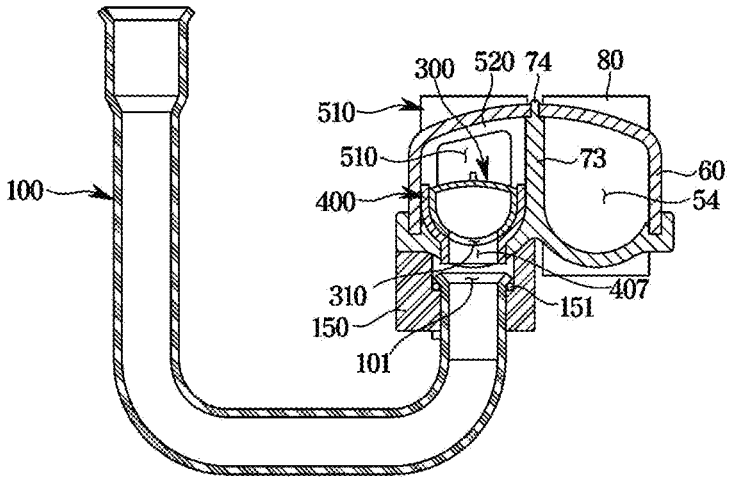
FIG. 14 is a cross-sectional view of FIG. 13.
Figure 15:
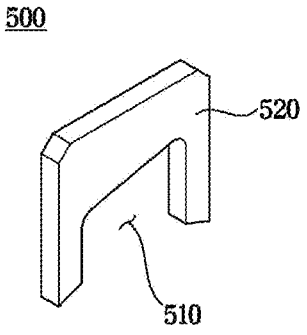
FIG. 15 is a perspective view illustrating the distribution baffle.
Figure 16:
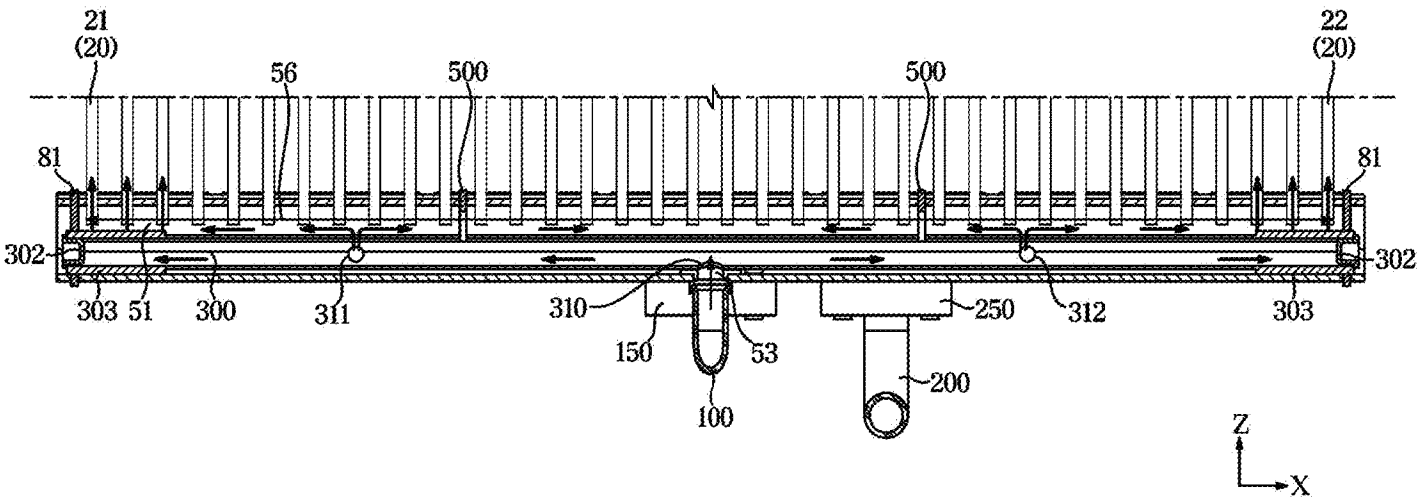
FIG. 16 is a side cross-sectional view of the heat exchanger shown in FIG. 1 from the front.

FIG. 13 is a view showing the distribution pipe, distribution pipe connector, and distribution baffles arranged in the first chamber. FIG. 14 is a cross-sectional view of FIG. 13. FIG. 15 is a view showing the distribution baffle. FIG. 16 is a side cross-sectional view of the heat exchanger shown in FIG. 1 from the front.

Referring to FIG. 13, the distribution baffle 500 may be provided in the first chamber 51. The distribution baffle 500 may contact an inner wall of the first chamber 51 to reduce the area of the flow path formed by the first chamber 51. Referring to FIG. 16, the distribution baffle 500 may be disposed between the plurality of distribution holes 311 and 312 of the distribution pipe 300. The refrigerant discharged from the plurality of distribution holes 311 and 312 may flow toward the center of the first chamber 51, and at this time, the area of the flow path may be reduced by the distribution baffle 500, resulting in resistance to the flow. Accordingly, the distribution baffle 500 may prevent the refrigerant discharged from the distribution holes 311 and 312 from being concentrated toward the center of the first chamber 51 and may help to ensure that the refrigerant is uniformly distributed within the first chamber 51.

Referring to FIGS. 14 and 15, the distribution baffle 500 may include a blocking portion 520 and a through hole portion 510. The blocking portion 520 may contact the inner surface of the first chamber 51 to reduce the area of the flow path formed by the first chamber 51. The blocking portion 520 may have a plate shape.

The through hole portion 510 may be provided to allow the refrigerant flowing within the first chamber 51 to pass therethrough. In other words, the blocking portion 520 may impart resistance to the flow of the refrigerant, but the refrigerant may flow through the through hole portion 510.

Referring to FIG. 16, the first chamber 51 may form a single flow path including the first region 56. The first row of tubes 20 may be coupled to the single flow path formed by the first chamber 51. The refrigerant flowing in from the inlet pipe 100 may be supplied to the first row of tubes 20 along the single flow path formed by the first chamber 51.

The second chamber 54 may also form a single flow path including the second region 57. The second row of tubes 30 may be coupled to the single flow path formed by the second chamber 54. The refrigerant supplied from the second row of tubes 30 may be discharged to the outlet pipe 200 along the single flow path formed by the second chamber 54 (see FIG. 3).

Figure 17:
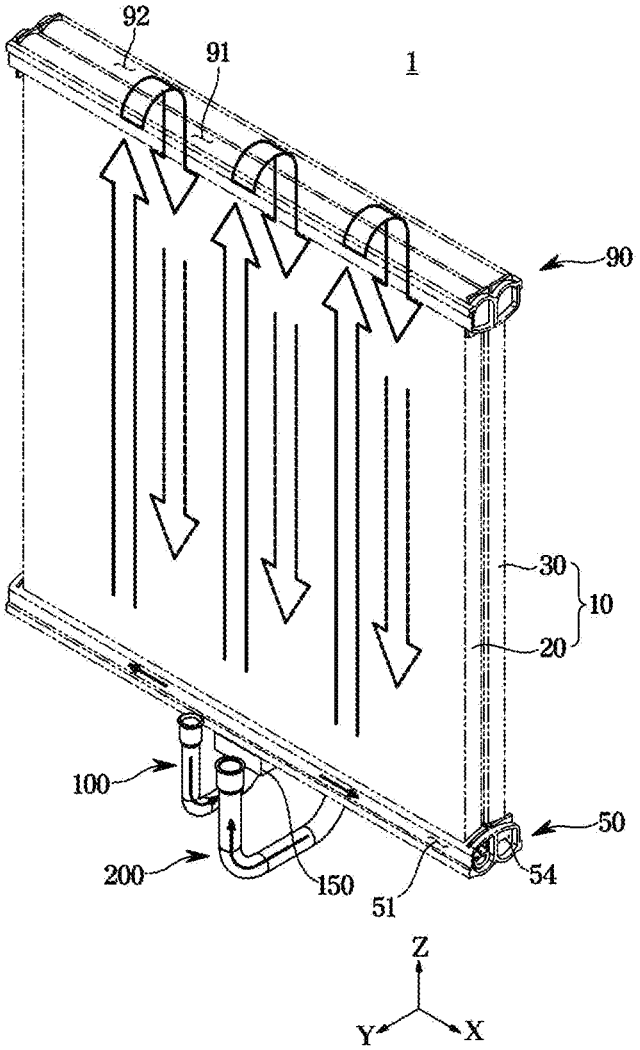
FIG. 17 is a view illustrating a flow of the refrigerant in the heat exchanger shown in FIG. 1.

FIG. 17 is a view showing a flow of the refrigerant within the heat exchanger shown in FIG. 1.

The refrigerant may flow into the first chamber 51 of the first header 50 via the inlet pipe 100. The refrigerant may exchange heat with external air while passing through the first row of tubes 20, flow to the third chamber 91 of the second header 90 and the fourth chamber 92 of the second header 90, and then flow back through the second row of tubes 30 to exchange heat with external air. The refrigerant may then be discharged to the outside through the second chamber 54 of the first header 50 and the outlet pipe 200.

While the present disclosure has been particularly described with reference to exemplary embodiments, it should be understood by those of skilled in the art that various changes in form and details may be made without departing from the spirit and scope of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A heat exchanger, comprising:

a plurality of tubes configured to enable refrigerant to flow therein, the plurality of tubes arranged along one direction and divided into a first row and a second row;

a header coupled to ends of the plurality of tubes and including a first chamber configured to supply refrigerant to the first row of tubes and a second chamber configured to receive refrigerant from the second row of tubes, wherein the first chamber includes a first region defined in the one direction between two tubes disposed at opposite ends of the first row of tubes, and the second chamber includes a second region defined in the one direction between two tubes disposed at opposite ends of the second row of tubes, the header further including a header body defining at least a portion of the first chamber and including a first chamber inlet, and a distribution pipe including: a distribution pipe inlet co-located in the first region and configured to communicate with the first chamber inlet, distribution holes, and a distribution baffle disposed in a flow path formed by the first chamber to impart resistance to a flow of the refrigerant discharged from the distribution holes of the distribution pipe;

an inlet pipe configured to communicate with the first chamber within the first region to supply refrigerant to the first chamber via the first chamber inlet;

a connector including a protrusion configured to be inserted in the first chamber inlet and a connection hole configured to communicate with the distribution pipe inlet and the first chamber inlet, and disposed between the distribution pipe and the header body; and an outlet pipe configured to communicate with the second chamber within the second region to discharge refrigerant of the second chamber.

2. The heat exchanger of claim 1, wherein the first chamber includes the first chamber inlet in communication with the inlet pipe and located in the first region to be supplied with refrigerant from the inlet pipe.

3. The heat exchanger of claim 2, wherein:

the distribution pipe is provided in the first chamber, and includes a plurality of distribution holes provided to discharge the refrigerant flowing in through the distribution pipe inlet into the first chamber, and the distribution pipe inlet is located in the first region of the first chamber corresponding to the first chamber inlet.

4. The heat exchanger of claim 3, wherein the distribution pipe inlet is located between the plurality of distribution holes in the one direction.

5. The heat exchanger of claim 3, wherein the distribution pipe further includes caps provided at opposite ends of the distribution pipe to close opposite ends of a flow path formed inside the distribution pipe.

6. The heat exchanger of claim 3, wherein the distribution baffle is located between the distribution pipe inlet and the distribution holes in the one direction.

7. The heat exchanger of claim 5, wherein the distribution pipe further includes an outer wall extending between the caps provided at opposite ends of the distribution pipe to form the flow path, and the distribution holes and the distribution pipe inlet are formed on the outer wall.

8. The heat exchanger of claim 2, wherein the connection hole of the connector is located in the first region of the first chamber corresponding to the distribution pipe inlet and the first chamber inlet.

9. The heat exchanger of claim 1, wherein the connector further includes:

a connection body configured to cover the distribution pipe to seal around the distribution pipe inlet, and wherein the protrusion protrudes from the connection body toward the first chamber inlet to contact the first chamber inlet.

10. The heat exchanger of claim 1, wherein:

the distribution pipe inlet is formed in a lower portion of the distribution pipe, the connector is disposed on a lower portion of the distribution pipe inlet, and the first chamber inlet is formed in a lower portion of the first chamber.

11. The heat exchanger of claim 8, wherein the refrigerant flowing through the inlet pipe flows into the distribution pipe through the first chamber inlet, the connection hole, and the distribution pipe inlet, and flows into the first chamber through the distribution holes.

12. The heat exchanger of claim 1, wherein the distribution baffle includes:

a through hole portion through which the refrigerant may pass, and a blocking portion contacting an inner surface of the first chamber to reduce an area of the flow path formed by the first chamber.

13. The heat exchanger of claim 1, wherein the first chamber forms a single flow path including the first region, and the second chamber forms a single flow path including the second region.

14. A heat exchanger comprising:

a plurality of tubes configured to enable refrigerant to flow therein, arranged along one direction and divided into a first row and a second row, a header coupled to ends of the plurality of tubes and including a first chamber configured to supply refrigerant to the tubes in the first row and a second chamber provided to receive refrigerant from the tubes in the second row, wherein the first chamber includes a first region defined in one direction between two tubes disposed at opposite ends of the tubes in the first row, and the second chamber includes a second region defined in the one direction between two tubes disposed at opposite ends of the tubes in the second row, the header further including a header body defining at least a portion of the first chamber and including a first chamber inlet, an inlet pipe configured to communicate with a first chamber inlet formed in the first chamber within the first region to supply refrigerant to the first chamber via the first chamber inlet, an outlet pipe configured to communicate with a second chamber outlet formed in the second chamber within the second region to discharge the refrigerant of the second chamber, a distribution pipe provided in the first chamber, and including a distribution pipe inlet co-located in the first region and configured to communicate with the first chamber inlet, a plurality of distribution holes configured to discharge the refrigerant flowing in through the distribution pipe inlet into the first chamber and a distribution baffle disposed in a flow path formed by the first chamber to impart resistance to a flow of the refrigerant discharged from the distribution holes of the distribution pipe, and a connector including a protrusion hole configured to be inserted in the first chamber inlet and a connection hole configured to communicate with the distribution pipe inlet and the first chamber inlet, and disposed between the distribution pipe and the header body.

15. The heat exchanger of claim 14, wherein the distribution pipe inlet of the distribution pipe is located within the first region of the first chamber corresponding to the first chamber inlet.

16. The heat exchanger of claim 14, wherein the header further includes:

the header body further including the first chamber inlet.

17. The heat exchanger of claim 14, wherein the connection hole of the connector is located in the first region of the first chamber corresponding to the distribution pipe inlet and the first chamber inlet.

18. The heat exchanger of claim 14, wherein:

the first chamber forms a single flow path including the first region, and the second chamber forms a single flow path including the second region.

* * * * *